US010480523B2

(12) United States Patent
Ohtachi et al.

(10) Patent No.: US 10,480,523 B2
(45) Date of Patent: Nov. 19, 2019

(54) VACUUM PUMP

(71) Applicant: Edwards Japan Limited, Chiba (JP)

(72) Inventors: Yoshinobu Ohtachi, Chiba (JP); Yasushi Maejima, Chiba (JP); Tsutomu Takaada, Chiba (JP)

(73) Assignee: Edwards Japan Limited, Chiba (JP)

( * ) Notice: Subject to any disclaimer, the term of this patent is extended or adjusted under 35 U.S.C. 154(b) by 194 days.

(21) Appl. No.: 15/545,145

(22) PCT Filed: Jan. 19, 2016

(86) PCT No.: PCT/JP2016/051420
§ 371 (c)(1),
(2) Date: Jul. 20, 2017

(87) PCT Pub. No.: WO2016/121573
PCT Pub. Date: Aug. 4, 2016

(65) Prior Publication Data

US 2017/0363101 A1 Dec. 21, 2017

(30) Foreign Application Priority Data

Jan. 30, 2015 (JP) ..... 2015-017258

(51) Int. Cl.
*F04D 29/08* (2006.01)
*F04D 17/16* (2006.01)
(Continued)

(52) U.S. Cl.
CPC ..... *F04D 29/083* (2013.01); *F04D 17/168* (2013.01); *F04D 19/042* (2013.01);
(Continued)

(58) Field of Classification Search
CPC .... F04D 17/168; F04D 19/042; F04D 19/046; F04D 29/083; F04D 29/403; F04D 29/4206
See application file for complete search history.

(56) References Cited

U.S. PATENT DOCUMENTS 6,343,910 B1 * 2/2002 Kawasaki ..... F04D 19/046 415/90
6,382,249 B1 * 5/2002 Kawasaki ..... C23C 16/4412 118/50
(Continued)

FOREIGN PATENT DOCUMENTS

DE 29717764 U1 11/1997
DE 10357547 A1 7/2005
(Continued)

OTHER PUBLICATIONS

EP Communication dated Jul. 25, 2018 and Supplementary Search Report dated Jul. 18, 2018 for corresponding European Application No. EP16743177.
(Continued)

*Primary Examiner* — Igor Kershteyn
(74) *Attorney, Agent, or Firm* — Westman, Champlin & Koehler, P.A.; Theodore M. Magee

(57) ABSTRACT

Provided is a vacuum pump having a stator disc having a divided structure, in which gaps or misalignments that occur between connection surfaces at which the divided structure is connected are reduced. In a turbo-molecular pump according to this embodiment, a mating relationship between a stator disc and a stator member for alignment (center-alignment) is opposite from that of the related art. Specifically, in a structure in which a base and the stator disc are fitted together, center alignment (positioning/centering) is performed through a structure in which an outer peripheral surface of the stator disc is held (restrained from an outer
(Continued)

side) by an inner peripheral surface of the base to be connected thereto. Further, the mating structure of the stator disc includes an integral component. Moreover, the mating position of a stator blade and the mating position of the stator disc having a Siegbahn structure are provided separately.

10 Claims, 11 Drawing Sheets

(51) Int. Cl.
*F04D 19/04* (2006.01)
*F04D 29/40* (2006.01)
*F04D 29/42* (2006.01)

(52) U.S. Cl.
CPC ..... *F04D 19/046* (2013.01); *F04D 29/403* (2013.01); *F04D 29/4206* (2013.01)

(56) References Cited

U.S. PATENT DOCUMENTS 6,409,468 B1 * 6/2002 Kawasaki ..... F04D 17/168 415/199.3
2010/0068054 A1 * 3/2010 Tollner ..... F04D 17/168 415/229
2016/0319825 A1 * 11/2016 Nonaka ..... F04D 17/168
2017/0248166 A1 * 8/2017 Ohtachi ..... F04D 19/04

FOREIGN PATENT DOCUMENTS

| | | | |
|---|---|---|---|
| EP | 0979947 | A2 | 2/2000 |
| EP | 2913533 | A1 | 9/2015 |
| JP | S6077795 | | 5/1985 |
| JP | H0465992 | A | 6/1992 |
| JP | H04330397 | A | 11/1992 |
| JP | 2501275 | Y2 | 6/1996 |
| JP | 2010504464 | A | 2/2010 |
| JP | 2011074903 | A | 4/2011 |
| JP | 5062257 | B2 | 10/2012 |
| WO | 2010016141 | A1 | 2/2010 |

OTHER PUBLICATIONS

PCT International Search Report for corresponding PCT Application No. PCT/JP2016/051420 dated Apr. 26, 2016.
PCT Written Opinion for corresponding Application No. PCT/JP2016/051420 dated Apr. 26, 2016.

* cited by examiner

VACUUM PUMP

CROSS-REFERENCE TO RELATED APPLICATION

This Application is a Section 371 National Stage Application of International Application No. PCT/JP2016/051420, filed Jan. 19, 2016, which is incorporated by reference in its entirety and published as WO 2016/121573 A1 on Aug. 4, 2016 and which claims priority of Japanese Application No. 2015-017258, filed Jan. 30, 2015.

BACKGROUND OF THE INVENTION

This invention relates to a vacuum pump. In particular, this invention relates to a vacuum pump including a stator disc having a divided structure.

Among vacuum pumps, a Siegbahn molecular pump having a Siegbahn structure has a helical groove (also referred to as a spiral groove or a swirling groove) flow passage on a front surface of at least one of a rotating disc and a stator disc arranged to have a gap (clearance) in the axial direction between the stator disc and the rotating disc, the front surface facing the gap.

Using the rotating disc, a momentum in a direction tangential to the rotating disc (that is, a direction tangential to a rotating direction of the rotating disc) is applied to diffused gas molecules entering the helical groove flow passage, to thereby exhaust the gas molecules with an advantageous directionality from an inlet port to an outlet port, provided by the helical groove.

In Japanese Utility Model Registration No. 2501275, a Siegbahn vacuum pump is described.

In Japanese Patent Application Publication No. 2011-074903, a turbo-molecular pump having the following configuration to reduce the number of components and promote efficiency in assembling is described. At least one stage of a plurality of stages of stator blades includes a plurality of divided stator blades arranged to be in contact with each other in a circumferential direction. The divided stator blades include a plurality of blades juxtaposed in the circumferential direction and an arc-like spacer portion that is connected to an outer periphery of those blades and is configured to position those blades in a predetermined position. As a result, a spacer ring of the related art is not needed.

In Japanese Patent No. 5062257, an inner diameter of the spacer ring is set to be larger than a maximum outer diameter of the stator blade to facilitate stacking of the stator blades and the spacer rings on an outlet port side in order.

The discussion above is merely provided for general background information and is not intended to be used as an aid in determining the scope of the claimed subject matter. The claimed subject matter is not limited to implementations that solve any or all disadvantages noted in the background.

SUMMARY OF THE INVENTION

FIG. 6 to FIG. 11 are views for illustrating the related art.

FIG. 7, FIG. 8A, and FIG. 8B are sectional views taken along the line b-b in FIG. 6 when seen from an outlet port 6 side.

FIG. 8B is an enlarged view of a section γ in FIG. 8A.

FIG. 10 is an enlarged view of a section δ in FIG. 9, and FIG. 11 is a view for illustrating a turbo-molecular pump 1000 illustrated in FIG. 9 in assembling.

As illustrated in FIG. 6, the turbo-molecular pump 1000, which is a Siegbahn pump having a Siegbahn structure as described in Japanese Utility Model Registration No. 2501275, may reduce a height dimension in an axial direction as compared to that of a Holweck pump.

However, when the Siegbahn structure is employed for a plurality of stages in the turbo-molecular pump 1000, a stator disc 5000 arranged to be inserted between an upper stage and a lower stage of rotor blades 9 needs to have a divided structure in order to enable the stator disc 5000 to be assembled from a lateral side of the rotor blades 9. In the divided structure, the stator disc 5000 is divided into semicircular shapes by being cut through a cut plane along an axis line n as illustrated in FIG. 7.

When the stator disc 5000 having the divided structure as described above is employed in parts in which a pressure increases (for example, an outlet port 6 side), there has been a problem in that gas to be exhausted flows back as indicated by the arrow in FIG. 6 from end surfaces of the stator disc 5000 at which the divided structure is connected (hereinafter referred to as connection end surfaces), thereby degrading an exhausting performance.

As illustrated in FIG. 8A and FIG. 8B, when a spiral groove is provided on the stator disc 5000 side, a misalignment between the connection end surfaces (axis line 1) may impair a continuity of the spiral groove, with the result that the exhausting performance is not always obtained as designed.

The structure described in Japanese Patent Application Publication No. 2011-074903 is a structure for preventing the performance from degrading at the connection end surfaces (or connection end portions) as described above.

In the related art described in Japanese Patent Application Publication No. 2011-074903 described above, as illustrated in FIG. 9 and FIG. 10, a stator disc 5100 is arranged to be in contact with a spacer ring 7000 serving as a stator member for positioning at an outer peripheral side of the spacer ring 7000, and be sandwiched by the upper and lower spacer rings 7000. That is, an outer peripheral surface of the spacer ring 7000 is a mating position (E) between the stator disc 5100 and the spacer ring 7000.

There is a problem in that gaps or misalignments are more liable to occur between the connection end surfaces of the stator disc 5100 because an inner peripheral surface of the stator disc 5100 is the mating position.

In this structure, as illustrated in FIG. 10 and FIG. 11, there is a problem in that working efficiency is low because the stator disc 5100 needs to be assembled to the turbo-molecular pump 1000 and to be fixed with an O ring 6000 serving as an elastic member.

In the turbo-molecular pump 1000, the pressure of the gas to be exhausted is higher in a region in which the Siegbahn structure (stator disc 5000 or 5100) is arranged than in a region in which a stator blade 10 is arranged, and hence there is a problem in that the gas to be exhausted is more liable to flow back when there are gaps or misalignments.

In the related art described in Japanese Patent No. 5062257, as described above, the semicircular stator blade is positioned in a radial direction by tapering an inner peripheral side wall surface of the spacer ring so as to apply load in the axial direction of the turbo-molecular pump, to thereby apply load in the radial direction as well.

However, the accuracy in the axial direction may be difficult to be obtained in the structure in which the surface having the tapered shape is formed.

Therefore, an object of this invention is to reduce gaps or misalignments that occur between connection surfaces at which a divided structure is connected in a vacuum pump having a stator disc having the divided structure.

In order to achieve the object described above, in the invention according to claim 1, there is provided a vacuum pump, including: a casing in which an inlet port and an outlet port are formed; a rotating shaft enclosed in the casing and rotatably supported; a rotating disc-shaped portion radially arranged on an outer peripheral surface of the rotating shaft or a rotating cylindrical body arranged on the rotating shaft; a stator disc-shaped portion arranged to be opposed to the rotating disc-shaped portion in an axial direction with a gap therebetween and to be concentric to the rotating disc-shaped portion; a spacer portion that fixes the stator disc-shaped portion; and a vacuum exhausting mechanism that transfers a gas sucked from the inlet port side to the outlet port side by interaction between the rotating disc-shaped portion and the stator disc-shaped portion, wherein the stator disc-shaped portion is positioned by an outer peripheral surface of the stator disc-shaped portion and an inner peripheral surface of the spacer portion.

The invention according to claim 2 provides the vacuum pump according to claim 1, in which the stator disc-shaped portion includes a protruding portion on a part of the outer peripheral surface thereof.

The invention according to claim 3 provides the vacuum pump according to claim 1 or 2, in which the stator disc-shaped portion is fixed by being applied with a pressure from an outer peripheral side by the inner peripheral surface of the spacer portion.

The invention according to claim 4 provides the vacuum pump according to claim 3, in which the pressure applied to the stator disc-shaped portion by the inner peripheral surface of the spacer portion is applied to a part of the outer peripheral surface of the stator disc-shaped portion.

The invention according to claim 5 provides the vacuum pump according to any one of claims 1 to 4, in which a corner of an upper end or a lower end of the stator disc-shaped portion on the outer peripheral side has a relief structure.

The invention according to claim 6 provides the vacuum pump according to any one of claims 1 to 5, in which the casing has a casing portion in which the inlet port is formed and a base portion in which the outlet port is formed, and in the spacer portion, a first spacer portion arranged closest to the outlet port side is formed integrally with the base portion.

The invention according to claim 7 provides the vacuum pump according to claim 6, further including a stator blade arranged to have a predetermined interval from the rotating disc-shaped portion, in which the stator blade is positioned by an inner peripheral surface of a second spacer portion different from the first spacer portion for positioning the stator disc-shaped portion.

The invention according to claim 8 provides the vacuum pump according to any one of claims 1 to 7, in which the rotating disc-shaped portion or the stator disc-shaped portion is a Siegbahn type in which a spiral groove having a root portion and a ridge portion is provided on at least a part of at least one of opposed surfaces of the rotating disc-shaped portion and the stator disc-shaped portion in the axial direction.

The invention according to claim 9 provides the vacuum pump according to any one of claims 1 to 8, in which the rotating disc-shaped portion or the stator disc-shaped portion is a turbo-molecular pump type in which a blade shape is provided on at least a part of at least one of opposed surfaces of the rotating disc-shaped portion and the stator disc-shaped portion in the axial direction.

The invention according to claim 10 provides the vacuum pump according to any one of claims 1 to 9, in which the stator disc-shaped portion includes a plurality of components.

According to this invention, in the vacuum pump having the stator disc having the divided structure, the gaps or misalignments that occur between the connection surfaces at which the divided structure is connected can be reduced, and hence the exhausting performance of the vacuum pump can be prevented from degrading as much as possible.

According to this invention, the stator disc having the Siegbahn structure and the divided structure is inserted in a base of the vacuum pump (that is, the mating structure is formed on the inner peripheral surface of the base). Through this configuration, the radial direction of the stator disc is restricted by the base, and hence the gaps or misalignments can be made less liable to occur.

According to this invention, in terms of the height direction, the stator disc is sandwiched by the spacer rings, and hence positioning can be performed accurately in both the radial direction and the axial direction of the stator disc.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DESCRIPTION OF THE PREFERRED EMBODIMENTS

(i) Outline of Embodiment

In a turbo-molecular pump according to this embodiment, a mating relationship between a stator disc and a stator member for alignment is integrated in a structure to be restrained from an outer side. That is, in a structure in which a base and the stator disc are fitted together, center alignment (positioning/centering) is performed through a structure in which an outer peripheral surface of the stator disc is held by an inner peripheral surface of the base to be connected thereto (restrained from the outer side).

In the turbo-molecular pump according to this embodiment, the mating structure of the stator disc includes an integral component.

In the turbo-molecular pump according to this embodiment, the mating position of a stator blade and the mating position of the stator disc having a Siegbahn structure are provided separately.

(ii) Detail of Embodiment

A preferred embodiment of this invention is described in detail below with reference to FIG. 1 to FIG. 5.

Figure 1:
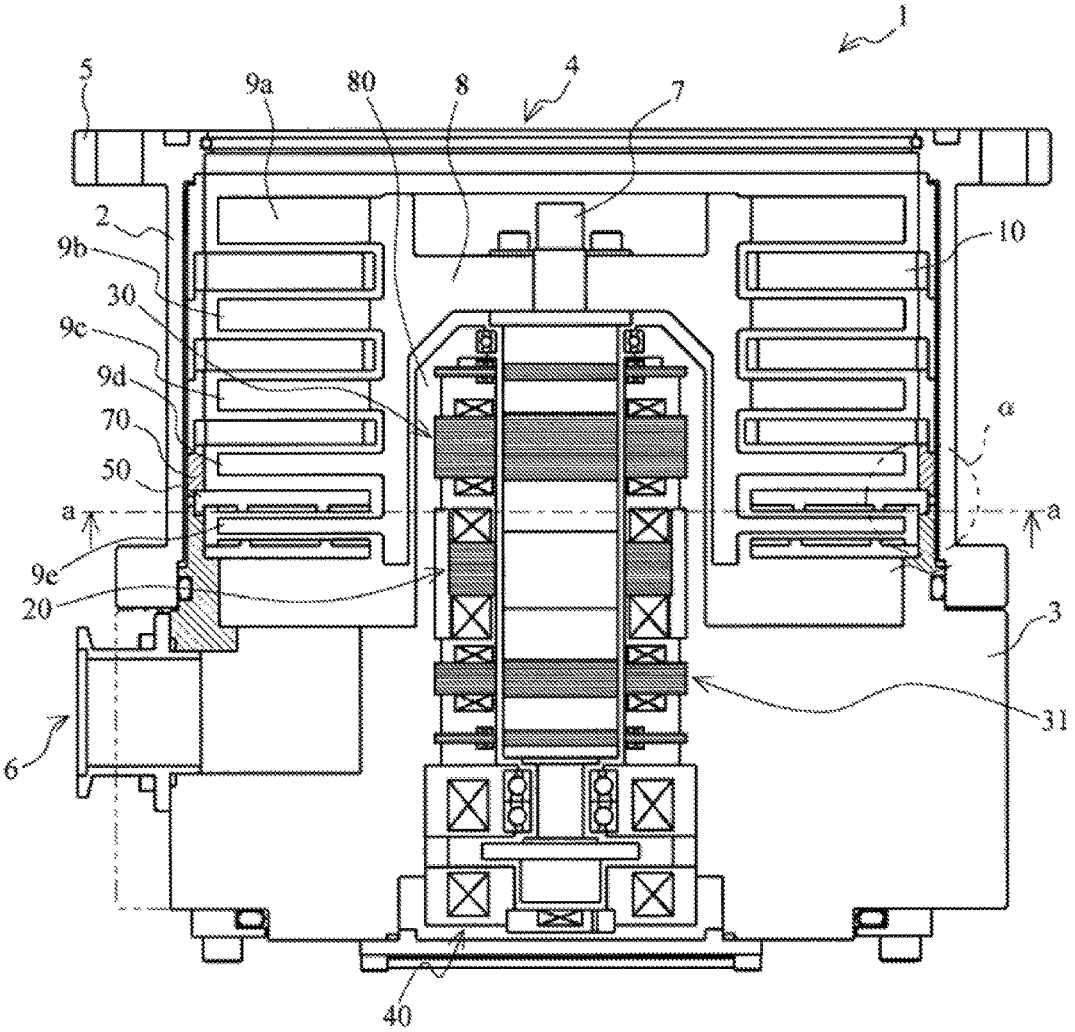
FIG. 1 is a view for illustrating a schematic configuration example of a vacuum pump.
Figure 2:
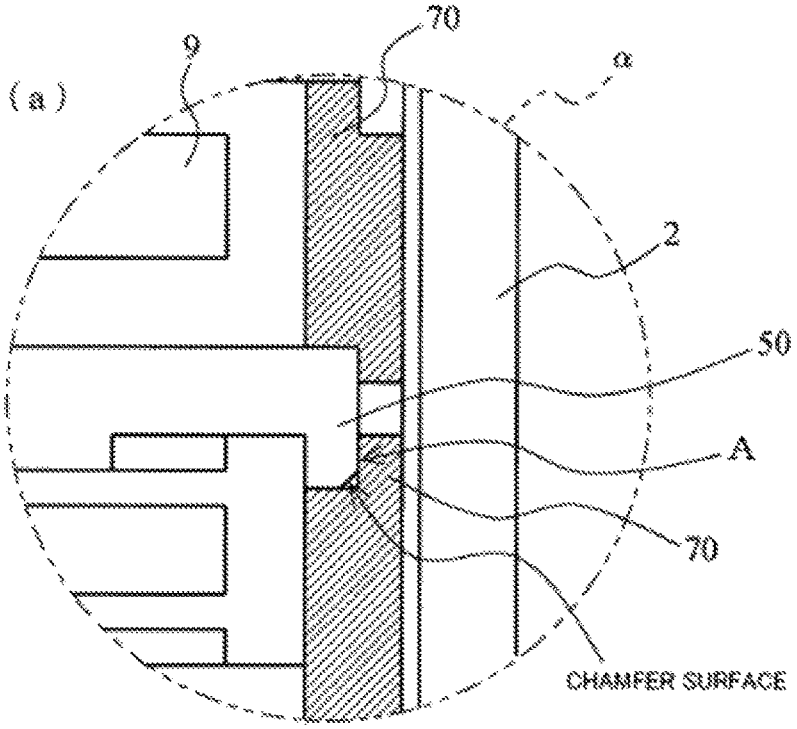
FIG. 2 is an enlarged view for illustrating a mating position.
Figure 2:
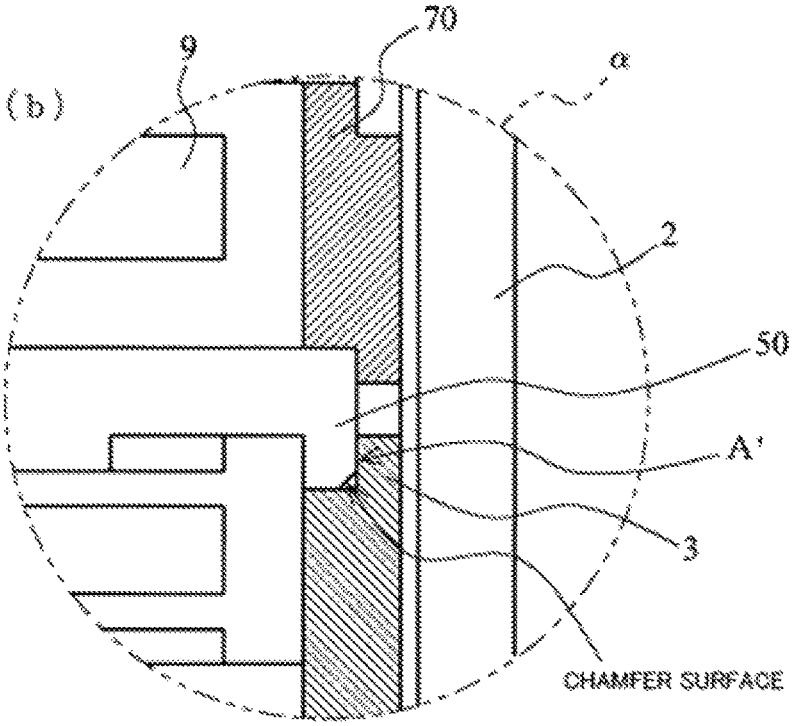
Figure 3:
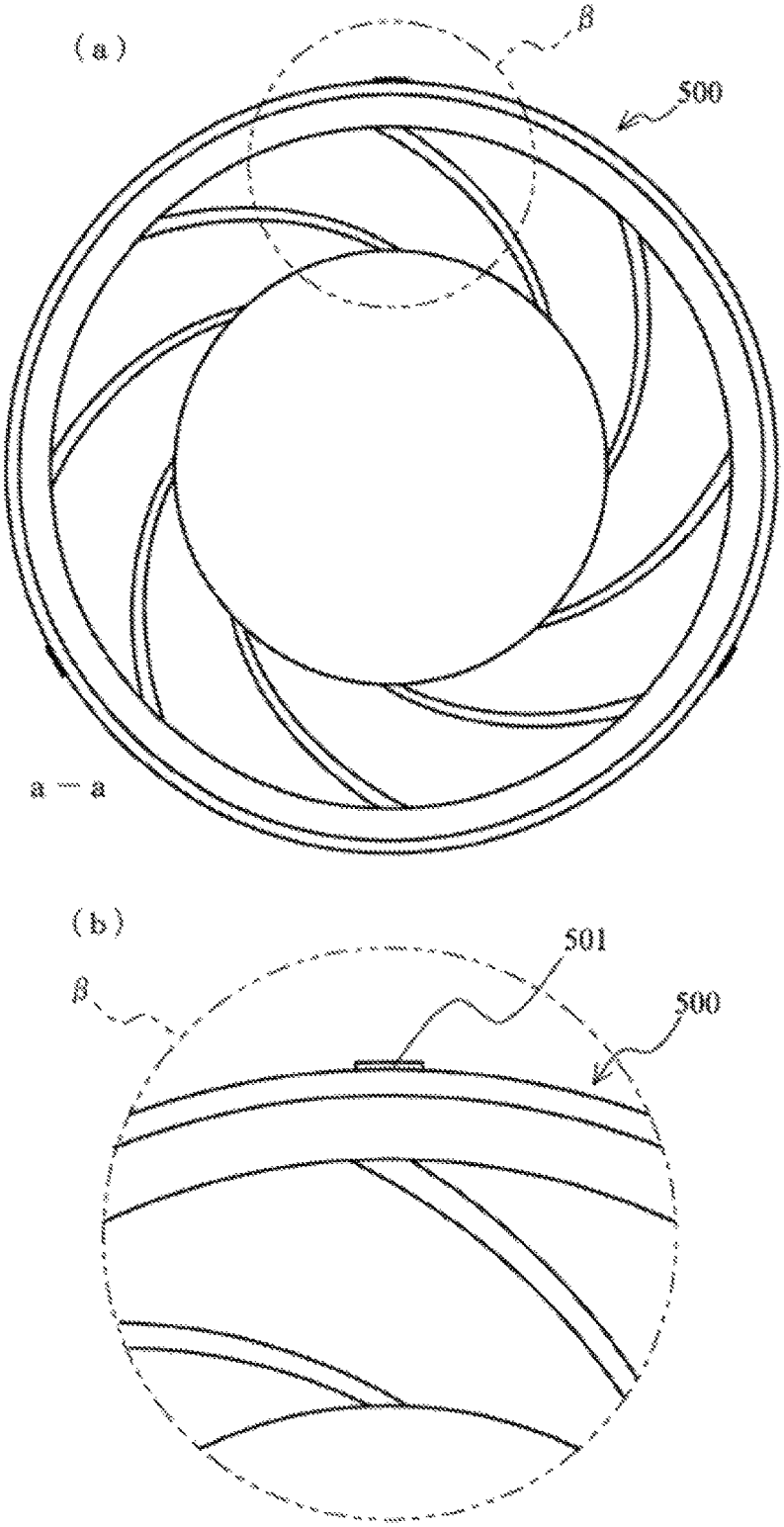
FIG. 3 is a view for illustrating a first modified example.

FIG. 1 is a view illustrating a schematic configuration example of a vacuum pump (turbo-molecular pump 1) according to a first embodiment of this invention, and is a sectional view of the turbo-molecular pump 1 in an axial direction.

In the embodiment of this invention, for the purpose of convenience, a diametrical direction of a rotor blade is described as a "radial (diametrical or radial) direction", and a direction normal to the diametrical direction of the rotor blade is described as an "axial direction".

A casing 2 forming a casing of the turbo-molecular pump 1 has a substantially cylindrical shape, and forms a chassis of the turbo-molecular pump 1 together with a base 3 provided below the casing 2 (outlet port 6 side). A gas transferring mechanism, which is a structure to cause the turbo-molecular pump 1 to fulfill an exhausting function, is accommodated in this chassis.

This gas transferring mechanism is roughly divided into a rotating portion (rotor portion) that is rotatably held (supported) and a stator portion fixed to the chassis.

Although not shown, a control apparatus that controls operation of the turbo-molecular pump 1 is connected to the outside of the casing of the turbo-molecular pump 1 through an exclusive line.

An inlet port 4 for introducing a gas into the turbo-molecular pump 1 is formed at an end portion of the casing 2. A flange portion 5 protruding to the outer peripheral side is formed on an end surface of the casing 2 on the inlet port 4 side.

Moreover, an outlet port 6 for exhausting the gas out of the turbo-molecular pump 1 is formed in the base 3.

The rotating portion includes a shaft 7 that is a rotating shaft, a rotor 8 arranged on the shaft 7, and a plurality of rotor blades 9 provided on the rotor 8. The rotor portion includes the shaft 7, the rotor 8, and the rotor blades 9.

The rotor blades 9 on the inlet port 4 side (9*a*, 9*b*, 9*c*, 9*d*) each have a blade shape and the rotor blade 9 on the outlet port 6 side (9*e*) has a disc shape.

A motor portion 20 for rotating the shaft 7 at high speed is provided around the middle of the shaft 7 in the axial direction, and is enclosed in a stator column 80.

Radial magnetic bearing apparatuses 30 and 31 for holding (supporting) the shaft 7 in the radial direction without any contact are provided on the inlet port 4 side and the outlet port 6 side of the motor portion 20 for the shaft 7. An axial magnetic bearing apparatus 40 for holding the shaft 7 in the axial direction without any contact is provided on a lower end of the shaft 7.

Stator blades 10 include blades extending toward the shaft 7 from an inner peripheral surface of the casing 2 while being inclined from a plane perpendicular to the axis line of the shaft 7 by a predetermined angle. The stator blades 10 are arranged for a plurality of stages along the axial direction on an inner peripheral side of the casing 2 so as to be staggered with the rotor blades 9.

As for the number of stages, an optional number of the stator blades 10 and (or) the rotor blades 9 needed to fulfill a discharging performance (exhausting performance) required for the vacuum pump may be provided.

A stator disc 50 has a disc shape radially extending to be perpendicular to the axis line of the shaft 7, and is a disc member in which a spiral groove is formed. In this embodiment, the stator disc 50 is formed to have a circular shape by connecting semicircular members to each other.

A spacer ring 70 is a stator member having a cylindrical shape, and the stator blade 10 and the stator disc 50 in each stage are fixed to be separated from each other through the spacer ring 70.

Through the configuration of the turbo-molecular pump 1 as described above, the turbo-molecular pump 1 performs a vacuum exhausting process in a vacuum chamber (not shown) arranged in the turbo-molecular pump 1.

FIG. 2A and FIG. 2B are enlarged views of a section α in FIG. 1, and enlarged views for illustrating a mating position (A) of this embodiment.

As illustrated in FIG. 2A, the mating position A is formed by fitting the stator disc 50 to the inner periphery of the spacer ring 70.

Specifically, the inner peripheral surface having a two-stage structure with two different inner diameters is formed on the spacer ring 70. Then, a dimension of an outer periphery of the stator disc 50 is determined so that an inner peripheral surface of the spacer ring 70 having the larger inner diameter and an outer peripheral surface of the stator disc 50 form a mating structure (mating position A).

Through this configuration, when the stator disc 50 and the spacer ring 70 are fit together to be assembled, the stator disc 50 is restrained from the outer side by the spacer ring 70. That is, the stator disc 50 is positioned from the outer side by the spacer ring 70.

As a result, as compared to when the stator disc 50 is positioned from the inner side, the gaps or misalignments between divided portions of the stator disc 50 may be reduced, and hence degradation of the exhausting performance of the vacuum pump may be suppressed.

The mating structure here does not have a dimensional relationship of a clearance fit, but has a dimensional relationship of a transition fit or a slight degree of an interference fit. Thus, the connection end surfaces are tight in contact, and hence the misalignments or the gaps between the divided portions of the stator disc 50 may be further reduced.

Through this configuration, the number of components may be reduced because the O ring used for fixedly fitting the stator disc 50 and the spacer ring 70 together is not needed. As a result, assembling may be facilitated and manufacturing costs may be reduced.

For the stator disc 50 arranged to be the second one from the outlet port 6 side, a mating position A' may be formed by fitting the stator disc 50 to the inner periphery of the base 3 as illustrated in FIG. 2B. That is, in this configuration, an upper surface of the base 3 and the spacer ring 70 arranged at the position nearest to the outlet port 6 are integrated.

Specifically, an inner peripheral surface (a surface on an inner peripheral side) having a two-stage structure with two different inner diameters is formed on the upper surface of the base 3. Then, the dimension of the outer periphery of the stator disc 50 is determined so that the inner peripheral surface having the larger inner diameter of the base 3 and the outer peripheral surface (a surface on an outer peripheral side) of the stator disc 50 form a mating structure (mating position A').

Through this configuration, when the stator disc 50 and the upper surface of the base 3 are fitted together to be assembled, the stator disc 50 is restrained from the outer side by the base 3. That is, the stator disc 50 is positioned from the outer side by the base 3.

As a result, the stator disc 50 may form the mating structure together with the base 3 serving as a reference, and hence an effect of reducing the possibility of a center misalignment may be obtained.

As illustrated in FIG. 2A and FIG. 2B, a corner of the lower end of the stator disc 50 on the outer peripheral side (outlet port 6 side) at the mating position (A or A') has a "relief" structure having a chamfer surface or an R-shape. Not only the lower end but also a corner of the upper end or the corners of both the upper end and the lower end may have the "relief" structure as described above.

Through this configuration, a connection surface that is the inserted side (stator disc 50) has a larger curve (the curve of an arc is gentler) than a connection surface that is the receiving side (the spacer ring 70 and the base 3). Thus, even if burrs, edges, and the like occur on the corner through processing, interference does not occur, and hence the inserting is facilitated and the assembling becomes easier.

The embodiment described above may be modified as below.

(iii) First Modified Example

FIG. 3A is a sectional view taken along the line a-a in FIG. 1 seen from the outlet port 6 side and FIG. 3B is an enlarged view of a section β in FIG. 3A.

A stator disc 500 according to a first modified example of this embodiment has a mating tongue portion 501 as illustrated in FIG. 3B.

Specifically, in the first modified example of this embodiment, in consideration of ease of assembly of the turbo-molecular pump 1, the mating structure of the stator disc 500 and the spacer ring 70 (or the base 3) is not formed around the entire outer periphery of the stator disc 500, but is formed on a part of the outer periphery of the stator disc 500.

That is, the mating tongue portions 501 for forming the mating structure are formed on several places at equal intervals on an outer peripheral surface of the stator disc 500.

It is desired that those mating tongue portions 501 be formed on at least three places, which is a minimum unit for the positioning (centering) of a cylindrical shape, on the outer peripheral surface of the stator disc 500. When the mating tongue portions 501 are formed on three or more places, it is preferred the number of places be an even number.

(iv) Second Modified Example

Figure 4:
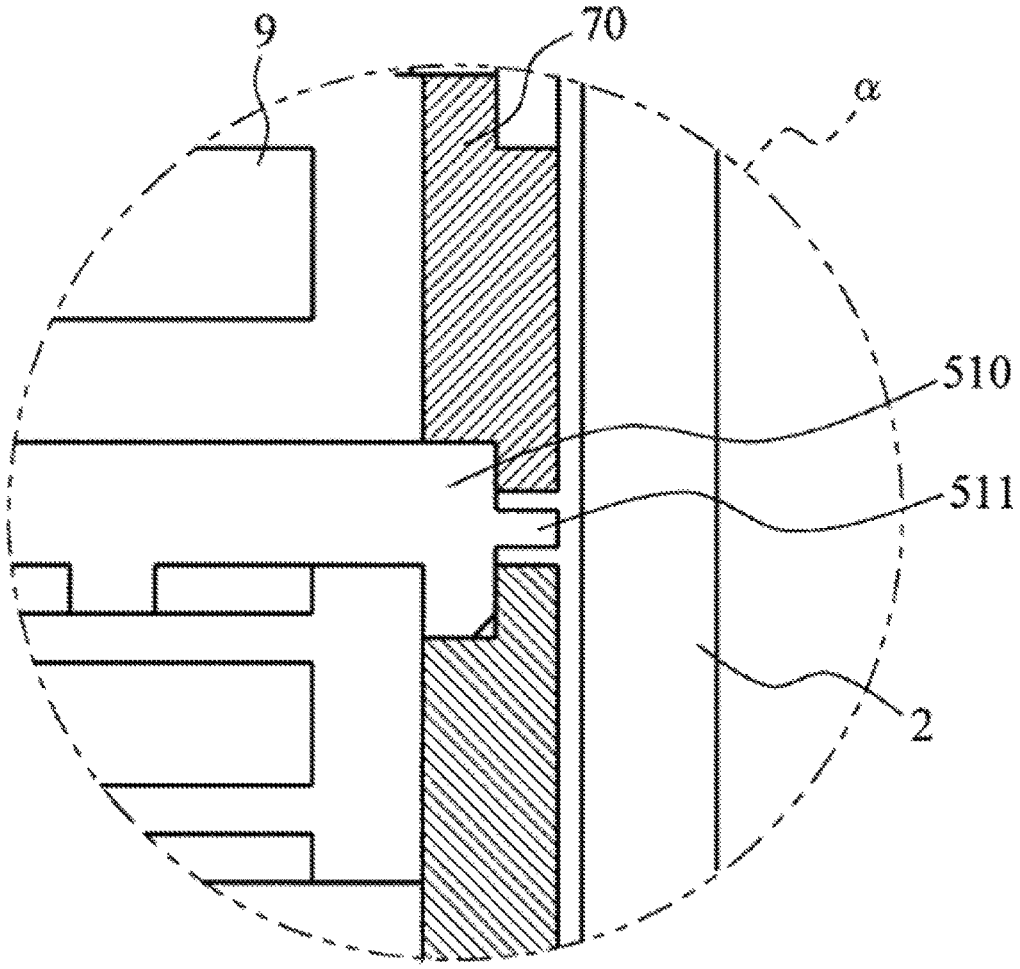
FIG. 4 is a view for illustrating a second modified example.

FIG. 4 is an enlarged view of the section α in FIG. 1.

A stator disc 510 according to a second modified example of this embodiment has a protruding portion 511 serving as a supporting structure used for assembly and deassembly of the turbo-molecular pump 1.

This configuration having the protruding portion 511 makes it easier to pick up the stator disc 510 when the stator disc 510 is held up, thus enhancing the working efficiency in assembling and disassembling.

The protruding portion 511 may be formed around the entire outer periphery of the stator disc 510, or may be formed on a part thereof.

(v) Third Modified Example

Figure 5:
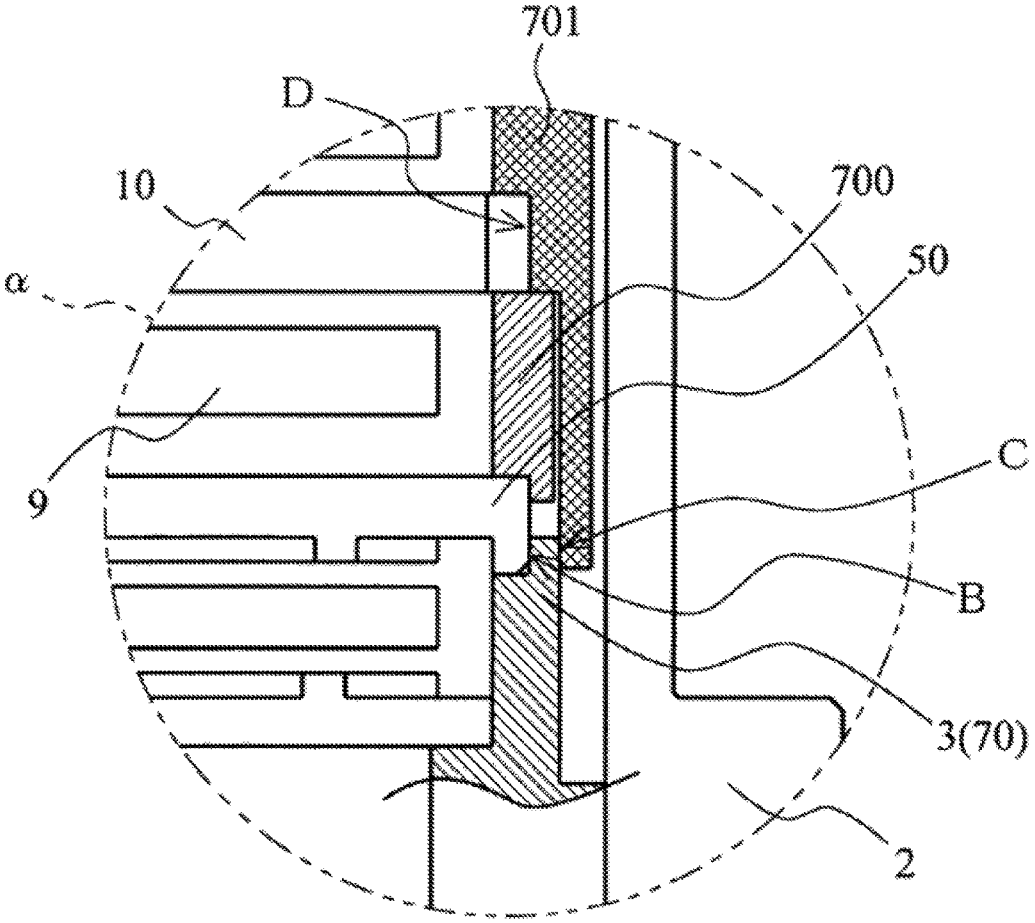
FIG. 5 is a view for illustrating a third modified example.
Figure 6:
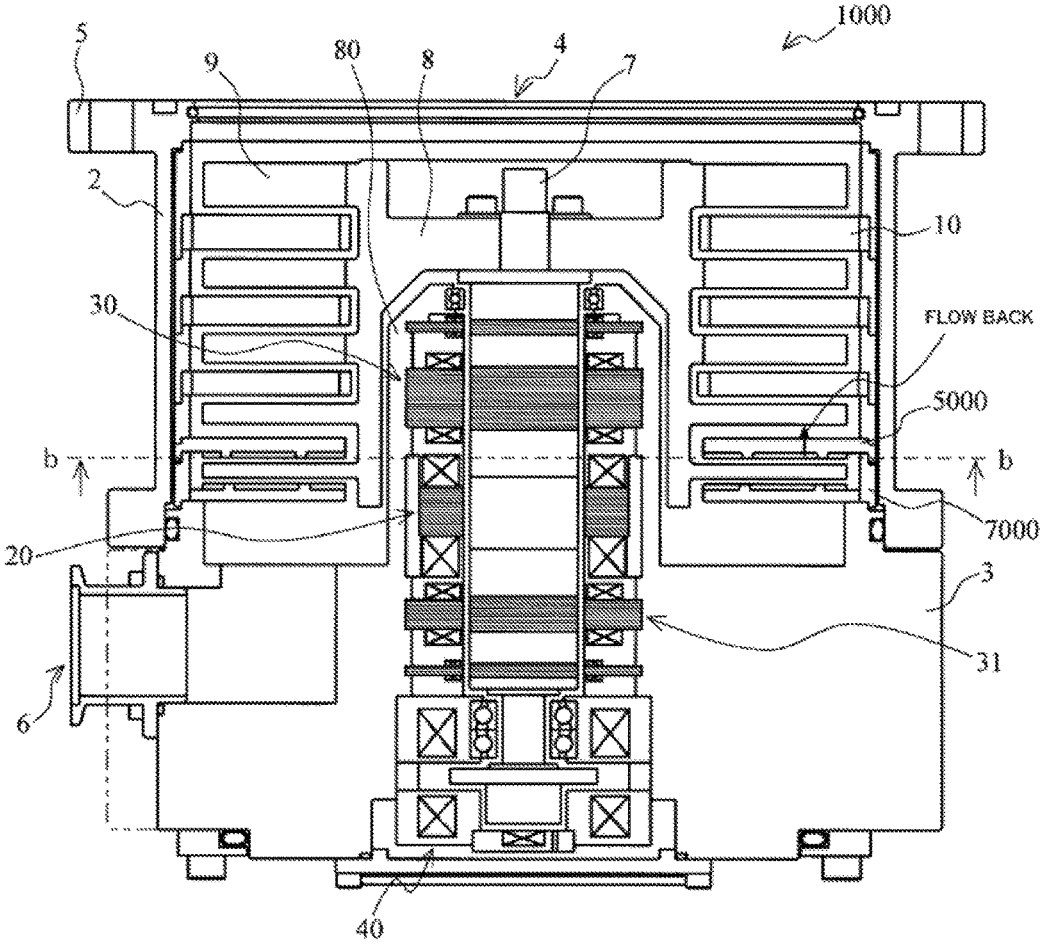
FIG. 6 (PRIOR ART)
FIG. 6 is a view for illustrating the related art.
Figure 7:
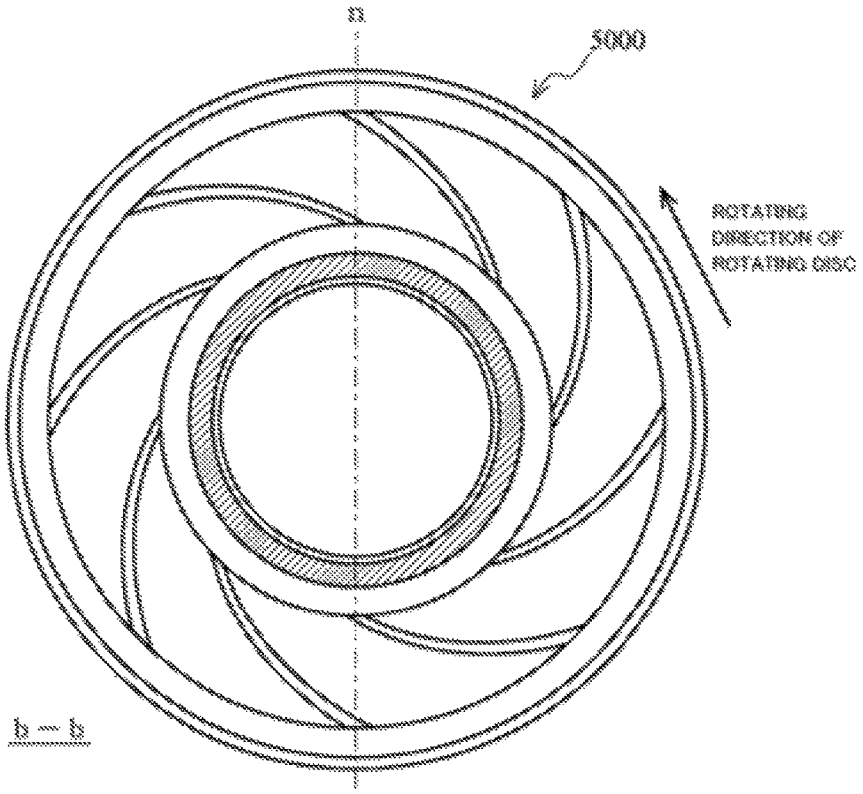
FIG. 7 (PRIOR ART)
FIG. 7 is a view for illustrating the related art.
Figure 8:
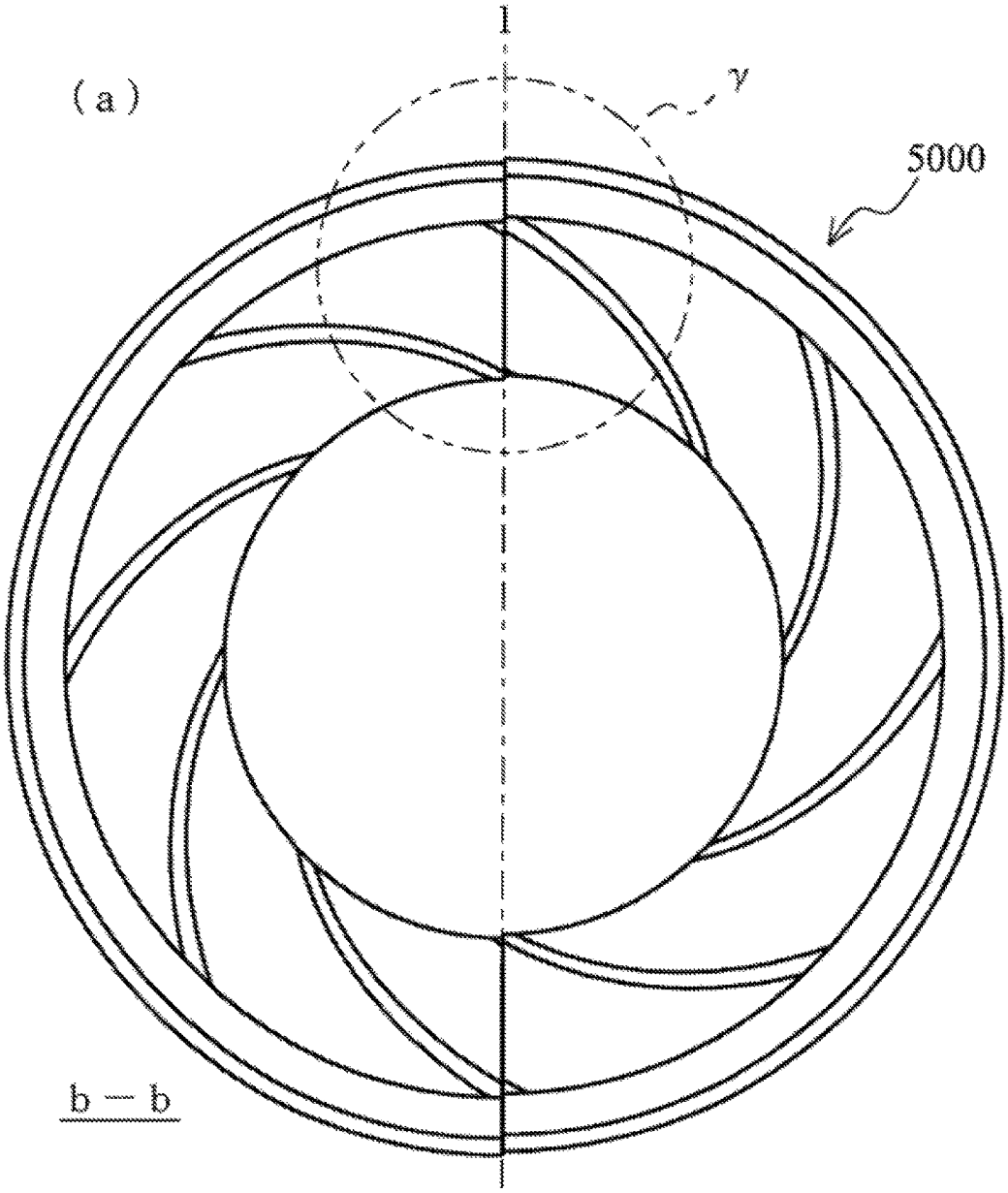
FIG. 8 (PRIOR ART)
FIG. 8 is a view for illustrating the related art.
Figure 9:
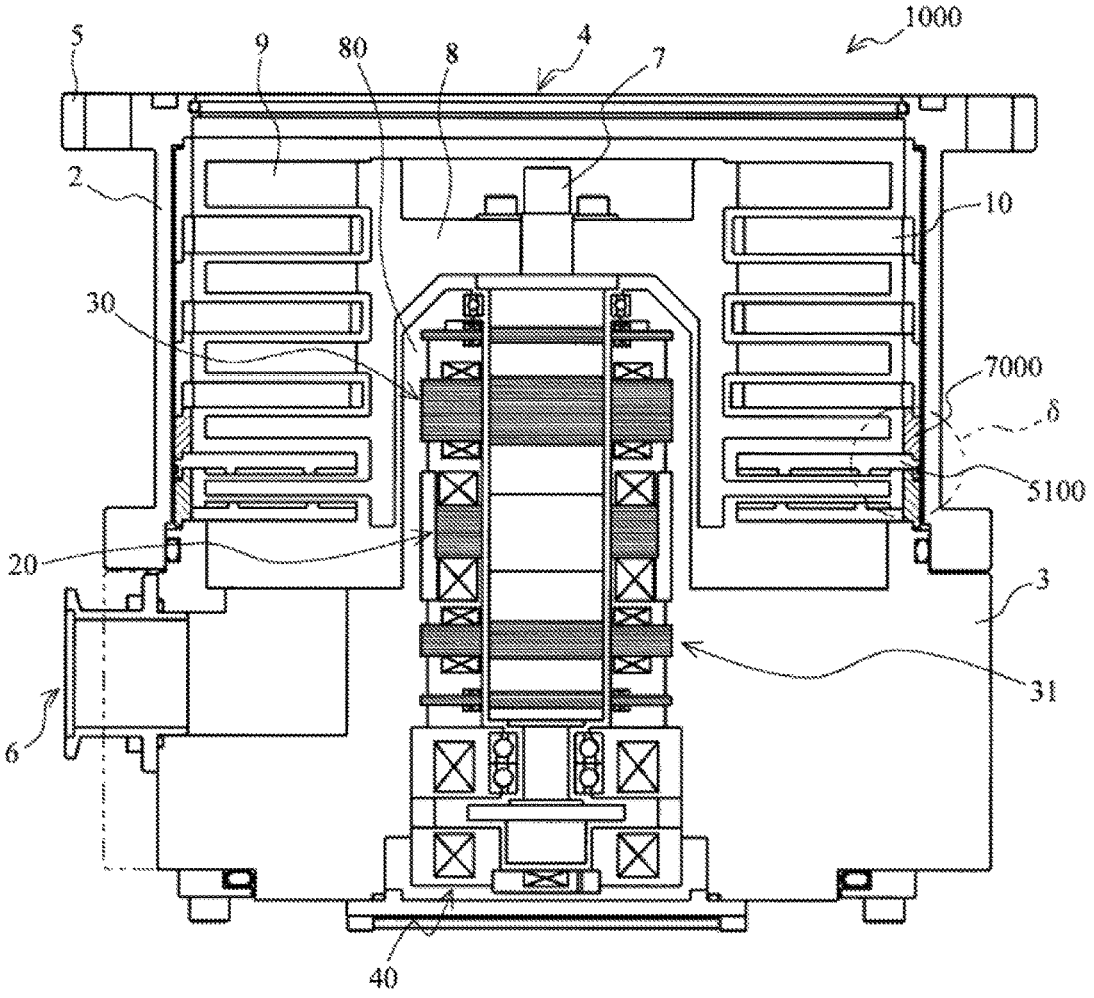
FIG. 9 (PRIOR ART)
FIG. 9 is a view for illustrating the related art.
Figure 10:
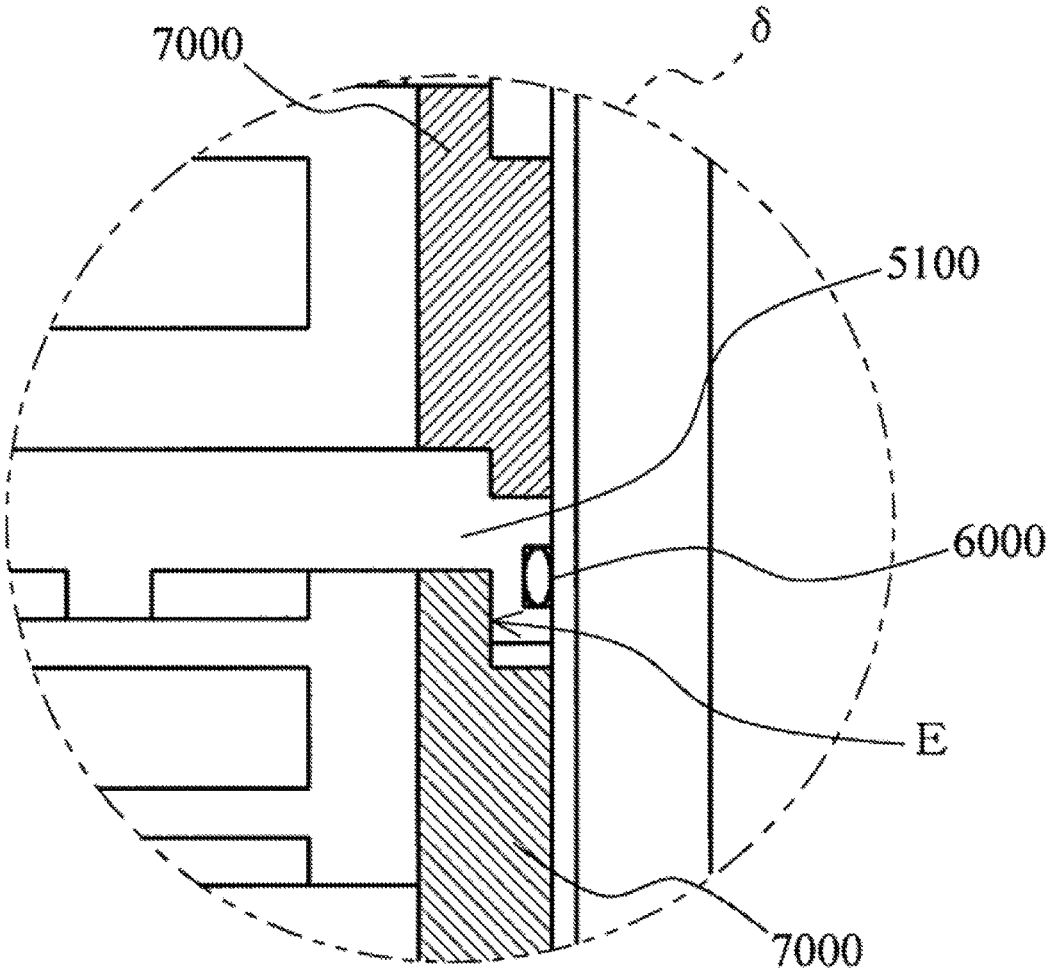
FIG. 10 (PRIOR ART)
FIG. 10 is a view for illustrating the related art.
Figure 11:
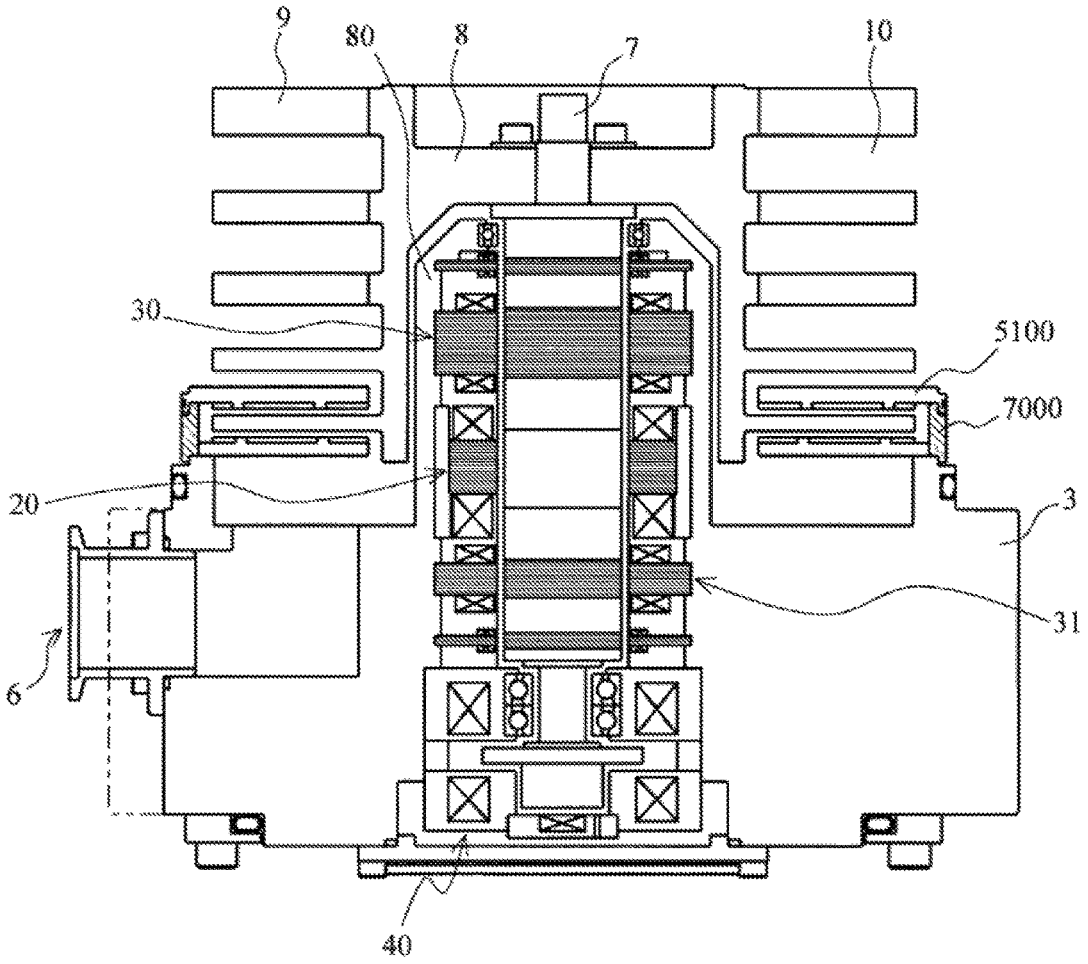
FIG. 11 (PRIOR ART)
FIG. 11 is a view for illustrating the related art.

FIG. 5 is an enlarged view of the surrounding of the section α in FIG. 1.

In a third modified example of this embodiment, the turbo-molecular pump 1 has a configuration in which a mating position (B) of the stator disc 50, a mating position (C) of a spacer ring 701, and a mating position (D) of the stator blade 10 are provided separately.

Specifically, as illustrated in FIG. 5, the stator disc 50 is fitted to the inner peripheral surface of the base 3 to form the mating position B, the outer peripheral surface of the base 3 is fitted to a first inner peripheral surface of the spacer ring 701 to form the mating position C, and the stator blade 10 is fitted to a second inner peripheral surface of the spacer ring 701 to form the mating position D.

(v-i) Mating Position B

The mating position B is a position of the mating structure formed of the outer peripheral surface of the stator disc 50 and the inner peripheral surface of the base 3 (or the spacer ring 70). The mating structure at the mating position B includes an inner peripheral surface having the larger inner diameter out of inner peripheral surfaces having a two-stage structure with two different inner diameters formed on the base 3 (or the spacer ring 70), and the outer peripheral surface of the stator disc 50.

Through this configuration, when the stator disc 50 and the base 3 (or the spacer ring 70) are fitted together to be assembled, the stator disc 50 is restrained from the outer side by the base 3 (or the spacer ring 70). That is, the stator disc 50 is positioned from the outer side by the base 3 (or the spacer ring 70).

The spacer ring 700 is restrained from the inner side by the stator disc 50. That is, the spacer ring 700 is positioned from the inner side by the stator disc 50.

(v-ii) Mating Position C

The mating position C is a position of the mating structure formed of the outer peripheral surface of the base 3 (or the spacer ring 70) and the inner peripheral surface of the spacer ring 701. The mating structure at the mating position C includes the end portion (outlet port 6 side) of the inner peripheral surface having the largest inner diameter (outermost inner peripheral surface) out of inner peripheral surfaces having a three-stage structure with three different inner diameters formed on the spacer ring 701, and the end portion (inlet port 4 side) of the outer peripheral surface of the base 3 (or the spacer ring 70).

Through this configuration, when the spacer ring 701 and the base 3 (or the spacer ring 70) are fitted together to be assembled, the spacer ring 701 is restrained from the inner side by the base 3 (or the spacer ring 70). That is, the spacer ring 701 is positioned from the inner side by the base 3 (or the spacer ring 70).

(v-iii) Mating Position D

The mating position D is a position of the mating structure formed of an outer peripheral surface of the stator blade 10 and the inner peripheral surface of the spacer ring 701. The mating structure at the mating position D includes the inner peripheral surface having the second largest inner diameter out of the inner peripheral surfaces having the three-stage structure with three different inner diameters formed on the spacer ring 701, and the outer peripheral surface of the stator blade 10.

Through this configuration, when the spacer ring 701 and the stator blade 10 are fitted together to be assembled, the stator blade 10 is restrained from the outer side by the spacer ring 701. That is, the stator blade 10 is positioned from the outer side by the spacer ring 701.

Through this configuration, the component of the stator blade 10 forming the mating structure and the component of the stator disc 50 forming the mating structure are different components, and hence an effect of reducing the possibility of a deviation from the reference may be obtained.

Through the configuration described above, in this embodiment and the modified examples, the stator disc 50 is inserted into the spacer ring 70 to form the mating structure on the inner side. As a result, the gaps or misalignments between the connection surfaces of the stator disc having the divided structure may be reduced, and the degradation of the exhausting performance may be suppressed.

On the outlet port 6 side, the stator disc 50 is inserted into the base 3 serving as the reference to form the mating structure on the inner side. As a result, the gaps or misalignments between the connection surfaces of the stator disc 50 having the divided structure may be further reduced, and the degradation of the exhausting performance may be further suppressed.

The exhausting performance may be prevented from degrading and the ease of assembly of the vacuum pump may be enhanced because the mating structure is not formed around the entire outer periphery of the stator disc 500 but is formed on a part thereof.

Contact to the components on the rotating side due to the misalignment between the connection surfaces may be reduced because the gaps or misalignments in the radial direction may be reduced through the mating structure described above.

As for the height direction, the stator disc is sandwiched by the spacer rings 70, and hence accurate positioning may be performed in both the radial direction and the axial direction (height direction) of the stator disc.

The embodiment and the modified examples of this invention may be combined with each other. The embodiment and the modified examples may be applied not only to the compound pump including the Siegbahn molecular pump section and the turbo-molecular pump section as described above, but also to a compound pump including the Siegbahn molecular pump section and a thread groove pump section, or a compound pump including the Siegbahn molecular pump section, the turbo-molecular pump section, and the thread groove pump section.

The embodiment and the modified examples may be applied to a configuration including only the Siegbahn molecular pump section or a configuration including only the turbo-molecular pump section.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump, comprising:

a casing in which an inlet port and an outlet port are formed;

a rotating shaft enclosed in the casing and rotatably supported;

a rotating disc-shaped portion radially arranged on an outer peripheral surface of the rotating shaft or a rotating cylindrical body arranged on the rotating shaft;

a stator disc-shaped portion arranged to be opposed to the rotating disc-shaped portion in an axial direction with a gap therebetween and to be concentric to the rotating disc-shaped portion;

a spacer portion that fixes the stator disc-shaped portion; and a vacuum exhausting mechanism that transfers a gas sucked from the inlet port side to the outlet port side by interaction between the rotating disc-shaped portion and the stator disc-shaped portion, wherein the stator disc-shaped portion is divided into at least two parts and is positioned by an outer peripheral surface of the stator disc-shaped portion and an inner peripheral surface of the spacer portion, and a connection surface of the divided stator disc-shaped portion separates a flow passage.

2. The vacuum pump according to claim 1, wherein the stator disc-shaped portion comprises a protruding portion on a part of the outer peripheral surface thereof.

3. The vacuum pump according to claim 1, wherein the stator disc-shaped portion is fixed by being applied with a pressure from an outer peripheral side by the inner peripheral surface of the spacer portion.

4. The vacuum pump according to claim 3, wherein the pressure applied to the stator disc-shaped portion by the inner peripheral surface of the spacer portion is applied to a part of the outer peripheral surface of the stator disc-shaped portion.

5. The vacuum pump according to claim 1, wherein a corner of an upper end or a lower end of the stator disc-shaped portion on the outer peripheral side has a relief structure.

6. The vacuum pump according to claim 1, wherein the casing has a casing portion in which the inlet port is formed and a base portion in which the outlet port is formed, and in the spacer portion, a first spacer portion arranged closest to the outlet port side is formed integrally with the base portion.

7. The vacuum pump according to claim 6, further comprising a stator blade arranged to have a predetermined interval from the rotating disc-shaped portion, wherein the stator blade is positioned by an inner peripheral surface of a second spacer portion different from the first spacer portion for positioning the stator disc-shaped portion.

8. The vacuum pump according to claim 1, wherein the rotating disc-shaped portion or the stator disc-shaped portion is a Siegbahn type in which a spiral groove having a root portion and a ridge portion is provided on at least a part of at least one of opposed surfaces of the rotating disc-shaped portion and the stator disc-shaped portion in the axial direction.

9. The vacuum pump according to claim 1, further comprising:

a turbo-molecular pump portion having rotor blades having blade shape and stator blades which are staggered with the rotor blades.

10. The vacuum pump according to claim 1, wherein the stator disc-shaped portion includes a plurality of components.

* * * * *